United States Patent [19]

Randall

[11] 4,129,865

[45] Dec. 12, 1978

[54] ALARM CIRCUIT FOR A DOOR LOCK

[76] Inventor: Lawrence Randall, 2339 N. Commonwealth, Chicago, Ill. 60614

[21] Appl. No.: 834,830

[22] Filed: Sep. 19, 1977

[51] Int. Cl.[2] ..... E05B 45/12

[52] U.S. Cl. ..... 340/542; 200/61.68

[58] Field of Search ..... 340/274 R; 200/61.68

[56] References Cited

U.S. PATENT DOCUMENTS

| | | | |
|---|---|---|---|
| 2,615,083 | 10/1952 | Krueger | 200/61.68 |
| 3,147,468 | 9/1964 | Daniels | 200/61.68 |
| 3,993,987 | 11/1976 | Stevens | 340/274 R |

OTHER PUBLICATIONS

Marston, R. M., "24 Easy-to-Build Burglar Alarms," *Radio-Electronics,* Jun. 1971, pp. 23-26, New York.

*Primary Examiner*—Glen R. Swann, III

[57] ABSTRACT

A latch tongue of a lock has a pair of contact points which are respectively connected to the gate and the cathode of a silicon controlled rectifier. When the lock is closed, the latch tongue is in a latch tongue housing which connects the points together thereby providing a connection between the gate and cathode. Additionally, the closing of the lock with a key causes a series connection of the anode and cathode of the rectifier with a bell and a voltage source. When the latch tongue is removed from the housing, the gate to the cathode connection is broken thereby causing the application of the voltage of the source to the bell.

3 Claims, 2 Drawing Figures

ALARM CIRCUIT FOR A DOOR LOCK

BACKGROUND OF THE INVENTION

1. Field of Invention

This invention relates to a lock for a door and more particularly to a lock having an alarm which is activated in response to an attempt to open the lock without a key.

2. Description of the Prior Art

A lock for a door is typically comprised of a tumbler assembly having a keyhole which is adapted to receive a key. Upon being received, the key may be rotated in a clockwise direction to cause an insertion of a latch tongue of the lock into a latch tongue housing thereof whereby the lock is closed and the door is locked. When the lock is closed, a spring maintains the tongue within the housing. Correspondingly, the key may be rotated in a counter clockwise direction to cause a removal of the latch tongue from the housing whereby the lock is opened and the door is unlocked. In the lock of the type described hereinbefore, a flexible piece of cardboard (about the size of a business card) may be forced into the housing against the tongue. The cardboard can then be used to push the tongue against the spring whereby the tongue is removed from the housing. It should be understood that because the cardboard may be used to remove the tongue from the housing, an intruder may easily open the lock.

Accordingly, there is a need for an alarm which is activated when the cardboard is used to push the tongue from the housing.

SUMMARY OF THE INVENTION

An object of the present invention is to provide a lock having an alarm which is activated in response to an attempt to open the lock without a key.

According to the present invention, a latch tongue of a lock inserted into a latch tongue housing thereof forms a connection between the gate and the cathode of a silicon controlled rectifier; the turning of a key in said lock causes an alarm to be connected in series with the anode and cathode of said rectifier and a voltage source; a removal of the latch tongue from the housing breaks said gate to cathode connection thereby causing an application of said source voltage to said alarm.

The invention provides a simple, economical and reliable alarm for a lock which is activated in response to an attempt to open the lock without a key.

Other objects, features and advantages of the present invention will become more apparent in the light of the following detailed description of a preferred embodiment thereof as illustrated in the accompanying drawing.

DESCRIPTION OF THE PREFERRED EMBODIMENT

Figure 1:
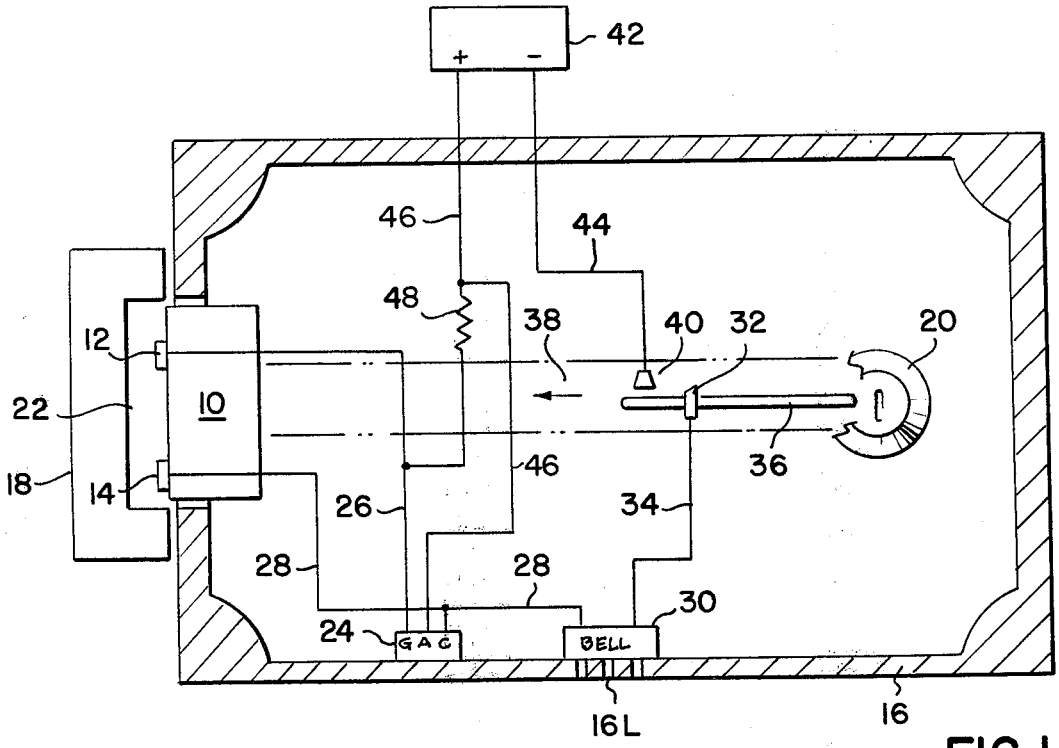
FIG. 1 is a section of a side elevation of a preferred embodiment of the present invention where portions are schematically shown.
Figure 2:
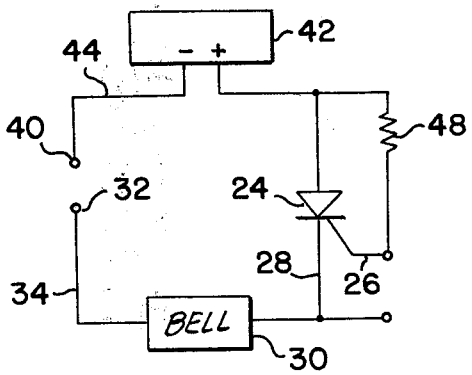
FIG. 2 is a schematic diagram of a circuit in the embodiment of FIG. 1.

Referring to FIG. 1 and FIG. 2, a lock is comprised of a latch tongue 10 having mounted thereon a pair of contact points 12, 14 which are electrically insulated from each other in any suitable manner. When the lock is open, the latch tongue 10 is maintained substantially within an enclosure 16 of the lock. Conversely, when the lock is closed, the latch tongue 10 is maintained substantially outside of the enclosure 16 and within a latch tongue housing 18. The lock is opened and closed by inserting a key into a keyhole of a tumbler assembly 20 connected to the latch tongue 10 and rotating the key.

The housing 18 is made from brass or any other suitable metal. When the latch tongue 10 is within the housing 18 an interior surface 22 thereof abuts the contacts 12, 14 thereby causing an electrical connection therebetween.

The contacts 12, 14 are connected to a silicon controlled rectifier 24 at the gate and cathode thereof, respectively, through signal lines 26, 28. As known to those skilled in the art, when the gate and the cathode of the rectifier 24 are at substantially the same electrical potential, current cannot flow from the anode to the cathode thereof. Accordingly, the electrical connection caused by the housing 18 prevents the flow of the current from the anode to the cathode.

The cathode is additionally connected to an alarm bell 30 at a first of two input terminals thereof through the line 28. The bell 30 has a second input terminal connected to a movable switch contact 32 through a signal line 34. The bell 30 is of a type which rings in response to a voltage being applied to its input terminals. Near the bell 30 are louvres 16L in the enclosure 16 through which the sound of the ringing is transmitted outside of the enclosure 16.

The contact 32 is mounted upon a rod 36 connected to the tumbler assembly 20. When a key in the tumbler assembly 20 causes an insertion of the latch tongue 10 into the housing 18, the rod 36 moves in a direction indicated by an arrow 38. The movement of the rod 36 causes an abutting relationship of contact 32 with a contact 40 maintained in a stationary position within the enclosure 16.

The contact 40 is connected to a negative terminal of a voltage source 42 through a signal line 44; a positive terminal of the source 42 is connected to the anode of the rectifier 24 through a signal line 46. Accordingly, when the contacts 32, 40 are in the abutting relationship, the bell 30, the anode and cathode of the rectifier 24 and the source 42 are all connected in series.

The gate and the anode are connected together through a resistor 48. When the tongue latch 10 is removed from the housing 18 while the contacts 32, 40 are in the abutting relationship, the connection of the gate and the anode through the resistor 48 causes the rectifier 24 to provide a low impedance between the anode and cathode whereby the voltage of the source 42 is substantially applied to the bell 30.

It should be understood that in an alternative embodiment, the source 42 may be an AC electrical power source.

Although the invention has been shown and described with respect to a preferred embodiment thereof, it should be understood by those skilled in the art that various changes and omissions in the form and detail thereof may be made therein without departing from the spirit and the scope of the invention.

I claim:

1. In a lock of the type having a latch tongue which is received within a latch tongue housing by rotating a key in a tumbler assembly, the improvement comprising: a voltage source;

a first contact connected to said tumbler assembly for movement in response to a rotation of said key;

a second contact which is stationary, said contacts being in an abutting relationship when said latch tongue is received within said housing;

a pair of contact points insulated from each other and mounted upon said latch tongue, said contact points being electrically connected together when said latch tongue is received within said housing;

a silicon controlled rectifier with the gate thereof connected to one of said contact points and the cathode thereof connected to the other of said contact points; and an electrically activated alarm connected in series with the anode and the cathode of said rectifier, said first and second contacts and said voltage source.

2. The lock of claim 1 where said voltage source provides a DC voltage.

3. The lock of claim 1 where said voltage source provides an AC voltage.

* * * * *